US006460235B1

(12) United States Patent
Del Fabro et al.

(10) Patent No.: US 6,460,235 B1
(45) Date of Patent: Oct. 8, 2002

(54) DEVICE TO PRODUCE REINFORCEMENT METAL CAGES

(75) Inventors: Giorgio Del Fabro, Tricesimo; Marcello Del Fabro, Udine, both of (IT)

(73) Assignee: M.E.P. Macchine Elettroniche Piegatrici SpA, Udine (IT)

( * ) Notice: Subject to any disclaimer, the term of this patent is extended or adjusted under 35 U.S.C. 154(b) by 0 days.

(21) Appl. No.: 09/688,166

(22) Filed: Oct. 16, 2000

(30) Foreign Application Priority Data

Nov. 16, 1999 (IT) ..... UD99A0206
Apr. 7, 2000 (IT) ..... UD00A0069

(51) Int. Cl.[7] ..... B21B 15/00

(52) U.S. Cl. ..... 29/33 F; 29/564.2; 29/33 K; 29/787; 29/795; 219/56; 140/112

(58) Field of Search ..... 29/564.2, 564.7, 29/33 F, 33 K, 771, 787, 791, 795, 429, 430, 431, 822, 466, 467, 468, 525.14, 559, 897.34; 140/112; 219/56, 80; 414/433; 269/289 R, 290, 297; 254/DIG. 12; 72/307

(56) References Cited

U.S. PATENT DOCUMENTS

| | | | | | |
|---|---|---|---|---|---|
| 1,928,534 | A | * | 9/1933 | Halkyard et al. | 219/56 |
| 2,225,226 | A | | 12/1940 | McFarland | |
| 3,008,496 | A | | 11/1961 | Goddard | |
| 3,213,898 | A | * | 10/1965 | Grady et al. | 140/112 |
| 3,370,150 | A | * | 2/1968 | Nordgren | 140/112 |
| 3,375,632 | A | | 4/1968 | Congy | |
| 3,604,180 | A | | 9/1971 | Wood | |
| 3,706,331 | A | * | 12/1972 | Pennington | 140/112 |
| 3,749,140 | A | * | 7/1973 | Debry | 140/112 |
| 3,837,372 | A | * | 9/1974 | Bernot | 140/112 |
| 4,538,042 | A | * | 8/1985 | Tanaka et al. | 219/56 |
| 5,665,254 | A | * | 9/1997 | Isono et al. | 219/56 |
| 6,148,873 | A | * | 11/2000 | Mehre | 140/112 |
| 6,223,785 | B1 | * | 5/2001 | Barden | 140/112 |

FOREIGN PATENT DOCUMENTS

| | | | |
|---|---|---|---|
| DE | 2720970 | | 11/1978 |
| EP | 435769 | | 7/1991 |
| EP | 667195 | | 8/1995 |
| EP | 791416 | | 8/1997 |
| EP | 0811442 | | 12/1997 |
| FR | 1238780 | | 12/1960 |
| FR | 1385289 | | 5/1965 |
| FR | 1482523 | | 8/1967 |
| FR | 2672628 | | 8/1992 |
| GB | 1455335 | | 1/1976 |
| JP | 6-226387 | * | 8/1994 |
| WO | 8505053 | | 11/1985 |

* cited by examiner

*Primary Examiner*—David P. Bryant
*Assistant Examiner*—T. Nguyen
(74) *Attorney, Agent, or Firm*—Antonelli, Terry, Stout & Kraus, LLP

(57) ABSTRACT

Device (10) to produce reinforcement metal cages comprising a plurality of longitudinal round pieces (13) associated with a plurality of stirrups (12) arranged at intervals along them, said device (10) comprising at least a supporting plane (20) on which said cage is progressively formed able to support rods (30) which complete the cage (11), lifting means **(31, 32, 33*a*, 33*b*) being provided along said supporting plane (20) to keep said rods (30) raised at least during the advance of the cage (11) which is progressively formed and to allow said rods (30) to be inserted inside the perimeter of the stirrups (12)**.

17 Claims, 5 Drawing Sheets

DEVICE TO PRODUCE REINFORCEMENT METAL CAGES

FIELD OF THE INVENTION

The invention concerns a device and method to produce metal cages for reinforced concrete structures such as beams, pillars or foundations.

BACKGROUND OF THE INVENTION

Metal cages used for reinforcement purposes in reinforced concrete structures comprise a plurality of longitudinal rods to which stirrups, separated lengthwise, are associated.

It is possible to assemble the cages manually or partly automatically, but in any case it is a long and complex process, particularly to position and distribute the stirrups and the longitudinal rods, since the workers are obliged to make continuous measurements before they can attach them, and there is a high probability of error.

Even when partly automatic machines are used, it is very problematic to position the round pieces in the correct attachment positions, to insert the longitudinal rods inside the perimeter of the stirrups, to move the partly or entirely assembled cages, to position the welding assemblies correctly, and other operations.

Moreover, the variety in the structure of such cages obliges the producer to make a personalized production, almost exclusively to order.

There has been a proposed solution wherein, in a first step, a substantially standardized pre-cage is made, by attaching two auxiliary round pieces outside the stirrups, and in a second step, and in a second zone, the cage is completed with the rods according to specifications.

However, this solution does not solve the problems of positioning and centering the stirrups, of feeding the auxiliary round pieces and of handling the pre-cage/completed cage.

To be more exact, in conventional solutions it is very problematic to insert the round pieces which complete the cage inside the perimeter of the stirrups, once the pre-cage has been completed.

Inserting the round pieces, especially in large-size cages, can require time comparable to the time taken to form the pre-cage, which means there is a risk of injury to the workers, the labor costs are expensive, equipment is needed and there is a risk of damage to the material.

The present Applicant has devised and embodied this invention to overcome these shortcomings and to obtain further advantages.

SUMMARY OF THE INVENTION

The invention is set forth and characterized in the main claims, while the dependent claims describe other characteristics of the invention.

The purpose of the invention is to achieve a device suitable to form reinforcement cages comprising at least two longitudinal round pieces able to connect the stirrups to each other so as to constitute a pre-cage; said device is suitable to facilitate the operations to insert the longitudinal rods which complete the cage inside the perimeter of the stirrups once the pre-cage has been completed.

The device according to the invention comprises at least a supporting plane on which the cage or pre-cage is made to advance gradually as it forms.

In a preferential embodiment, there are step-wise feed means included for the longitudinal round pieces to be attached to the stirrups, means to position at least one stirrup at a time between the round pieces in the attachment position and at least a work assembly for at least each one of said longitudinal round pieces.

According to the invention, the rods which according to specifications have to be inserted inside the stirrups which complete the cage are deposited on the supporting plane on which the cage or pre-cage is progressively formed.

The supporting plane has or cooperates with means to keep said rods at least temporarily raised, in order to allow the lower side of the stirrups to pass.

The lifting means are able to allow the free advance of the stirrups without interfering with them, allowing the rods to be progressively inserted inside the stirrups as the cage is gradually formed and as a growing number of stirrups advance on the supporting plane.

Therefore, already when the pre-cage is being formed, the rods which complete the cage are inserted inside the perimeter of the stirrups: this considerably facilitates the subsequent finishing steps.

According to a variant, at the opposite end of the rods from that where the stirrups are introduced, there are means able to define an at least temporary abutment position for the rods.

According to another variant, the position of said abutment means can be regulated according to the length of the rods.

In a first embodiment, the lifting means comprise at least a roller located orthogonal to the axis of advance of the cage along said supporting plane and partly protruding therefrom.

According to this first embodiment, the roller has a plurality of radially arranged paddles on its circumference; the number of the paddles is such that they are always operating on the rods.

In a preferential embodiment, there are six paddles.

The axis of the roller is arranged, with respect to the supporting plane, in such a manner that the paddles protrude partly from said plane for an entity correlated to the desired value by which the rods are lifted.

The paddles of the roller keep the rods raised, allowing the lower side of the stirrups to pass below them; the paddles however do not interfere with the advance of the stirrups since the rollers are made to rotate when the lower side of a relative stirrup enters into contact with the first paddle and makes it rotate.

According to a variant, the means to keep the rods raised for the stirrups to pass comprise two or more movable blades arranged at intervals along the supporting plane, wherein at least a front blade and a rear blade have alternately a respective raised working position and a lowered inactive position.

When a stirrup is approaching the group of blades, the front blade is raised to keep the rods high, while the rear blade is lowered and lets the stirrup pass; then, the rear blade is lifted to lift the rods, while the front blade is lowered to allow the stirrup to pass.

According to a variant, the device also comprises means to make the stirrups in a manner which is functionally and temporally correlated to the progressive formation of the cage on the supporting plane by said work assemblies.

The means to make the stirrups, in a further embodiment, are associated with automatic loading means able to pick up on each occasion one or more prepared stirrups and to put them in said means and between the round pieces advancing step-wise, in a defined attachment position.

The feed means of the round pieces may consist of drawing means with rollers, gripper means with alternate movement, track means, or chains, or other similar or identical systems.

According to one embodiment of the invention, the round pieces arrive from a roll and cooperate with straightening means arranged upstream and/or downstream of the feed means.

According to a further variant, the round pieces are already pre-straightened and of the desired length.

In a first embodiment, for each round piece, there are attachment means able to make the round piece solid with one or more stirrups simultaneously, which stirrups are located on each occasion in the positioning means.

The attachment means, in the preferential embodiment, consist of one or more welding assemblies. In an advantageous embodiment, the welding assembly cooperates with pressure means to position and center the round piece with respect to the relative stirrup in order to improve the effectiveness and hold of the welding.

According to another embodiment, the work assembly also comprises shears means able to cut a relative round piece when the cage, or pre-cage, is substantially complete, or when it is necessary to cut the front part of the cage from the rear part. The shears means therefore also perform the function of emergency shears in the event of a blockage or malfunction.

According to a variant, there are also means able to achieve, on each round piece and in a manner correlated to the feed step, one or more loops in correlation with the position of the stirrup or stirrups and distanced lengthwise.

The loops are aligned lengthwise on at least one round piece and have a convex shape facing outwards; they define seatings in which the stirrups cooperate and are then attached to said round pieces.

According to another feature of this invention, the supporting plane and the work and feed assemblies cooperating with the round pieces have a reciprocal position which can be regulated at least vertically.

In a first embodiment, the supporting plane can be regulated in height in order to define the height at which the round pieces are positioned with respect to the stirrups. In another embodiment, all the work and/or feed assemblies can be regulated together, at least in height, with respect to the supporting plane.

According to another embodiment, each work assembly and/or feed assembly of a relative round piece can be regulated independently so as to define the attachment position of the round piece on the stirrup.

BRIEF DESCRIPTION OF THE DRAWINGS

These and other characteristics of the invention will become clear from the following description of some preferential embodiments, given as a non-restrictive example, with reference to the attached drawings wherein.

DETAILED DESCRIPTION OF SOME PREFERRED FORMS OF EMBODIMENT

Figure 1A:
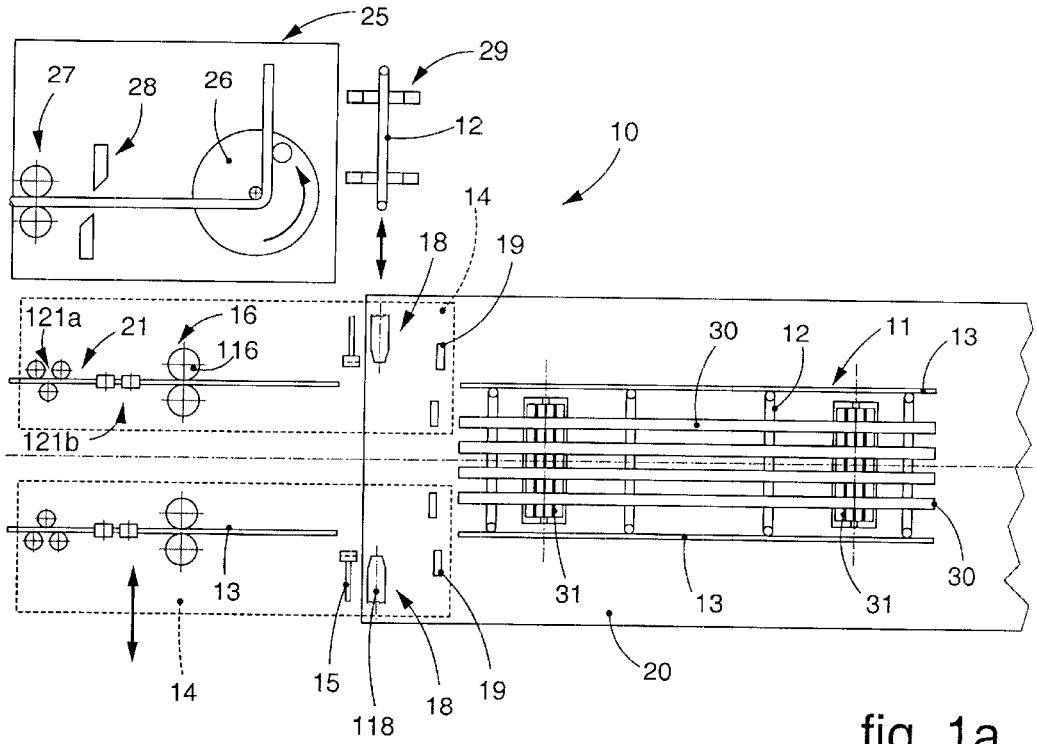
FIGS. 1*a*–1*d* show schematically, with a view from above, a device to produce reinforcement cages according to the invention in the various steps of the work cycle.

In the attached Figures, the number 10 indicates in its entirety a device to produce reinforcement cages or pre-cages 11 consisting, in this case, of three longitudinal round pieces 13 and at least some of the stirrups 12 which will constitute the finished cage. The longitudinal round pieces 13 are attached, in this case, outside the relative stirrups 12 and may be auxiliary rods, or specification rods, that is to say, having a structural function as well as connecting the stirrups 12, particularly in smaller cages 11.

The invention is applied also to cages or pre-cages 11 comprising two, four or more inner or outer round pieces 13, which can cooperate with the upper or lower sides or with the corners of the stirrups 12.

The device 10 comprises, for each of said longitudinal round pieces 13, feed means 16 and straightening means 21.

The feed means 16 comprise, in this case, a drawing assembly with rollers 116 able to unwind a longitudinal round piece 13 from a relative roll (not shown here) and to draw it through the respective straightening means 21. The straightening means 21 comprise, in this case, two assemblies of rollers, respectively 121*a* and 121*b* arranged and acting on two planes orthogonal to each other.

According to a variant not shown here, there is a single drawing assembly with rollers 116 for all three longitudinal round pieces 13. According to another variant which is not shown, the feed means comprise alternate motion grippers, chains, tracks or other identical or similar means.

The device 10 also comprises, for each round piece 13, a work assembly 14 equipped with at least attachment means 18 to attach the round piece 13 and the relative stirrup 12, and a supporting plane 20 arranged downstream of the work assemblies 14 and on which the cage or pre-cage 11 is progressively formed.

Between the drawing assembly 116 and the relative work assemblies 14 there may be a guide tube for a relative longitudinal round piece 13.

The supporting plane 20 extends at least as far as a position below the attachment means 18 so as to constitute a lower supporting element for the stirrups 12 as they are positioned on each occasion in the welding or tying position.

The method to make the reinforcement cage involves positioning definitive longitudinal rods 30, as required by the specification, inside the perimeter of the stirrups 12 as a pre-cage II is gradually formed on the supporting plane 20.

To obtain this, the invention includes positioning the rods 30, keeping them slightly raised with respect to the plane 20, so as to allow the free passage of the stirrups 12, and in particular the passage of the lower side of the stirrups 12 below the rods 30.

In the embodiment shown here, along the supporting plane 20 there are two rollers 31 of the type with rigid radial paddles 32, arranged with their axis substantially orthogonal to the direction of feed of the stirrups 12 on the plane 20. The rollers 31 are arranged partly below the surface of the supporting plane 20 so that the radial paddles 32, in this case six of them, protrude from the plane 20 and keep the rods 30 raised with respect thereto.

Figure 3A:
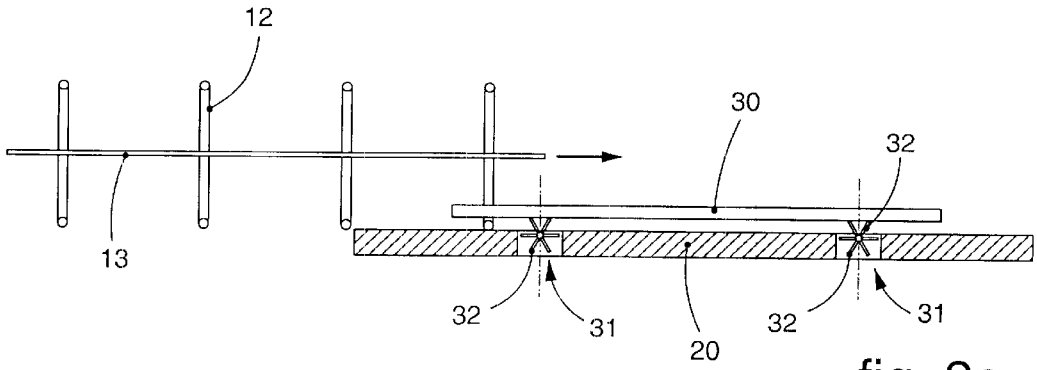
FIGS. 3*a*–3*c* show schematic side views of a detail of the lifting means according to the invention.
Figure 3B:
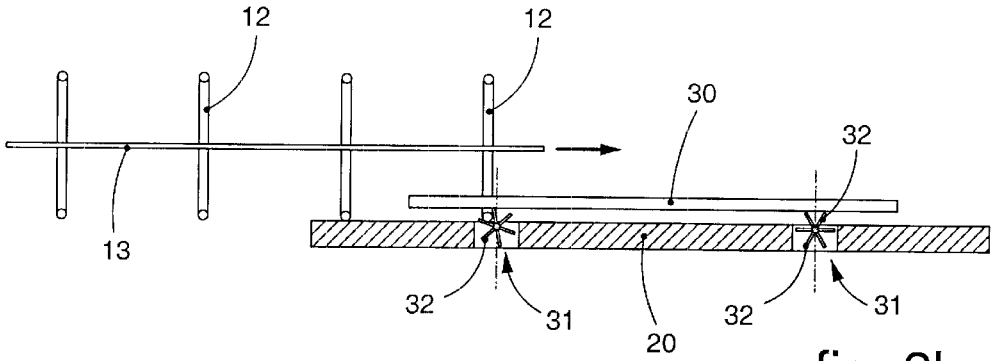
Figure 3C:
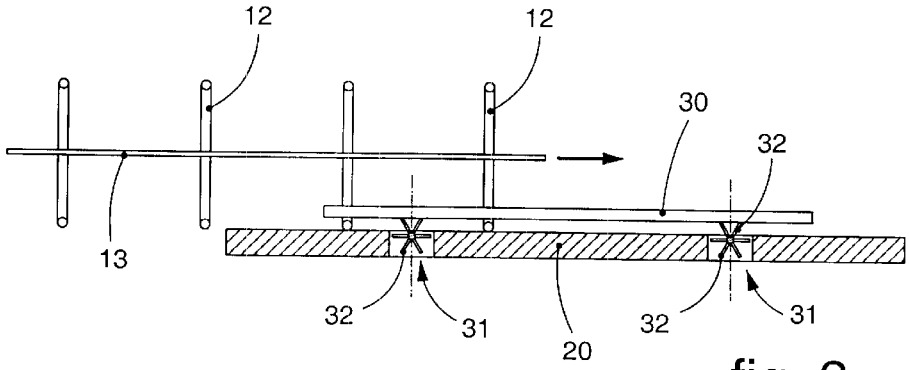

The first stirrup 12 advancing on the supporting plane 20 can thus pass with its lower side below the rods 30 (FIG. 3*a*)

and, when it meets the first paddle 32 (FIG. 3*b*), it makes it rotate, with the relative roller 31, and can thus continue its advance without interference (FIG. 3*c*).

All the stirrups 12 in the pre-cage 11 can advance in this way so that, when the pre-cage 11 is complete, the rods 30 as laid down by the specifications are already inside the perimeter of the stirrups 12. In this way, in a second stage and in a second finishing zone of the cage, it is not necessary to make the complicated operation of inserting the longitudinal rods, which can even reach twelve meters in length, inside the stirrups 12 after the pre-cage 11 has been completed.

The pre-cage 11 thus made, with the definitive rods 30 already inside, can be translated to an adjacent zone for finishing where the rods 30 can be attached, either manually or partly automatically.

Figure 4A:
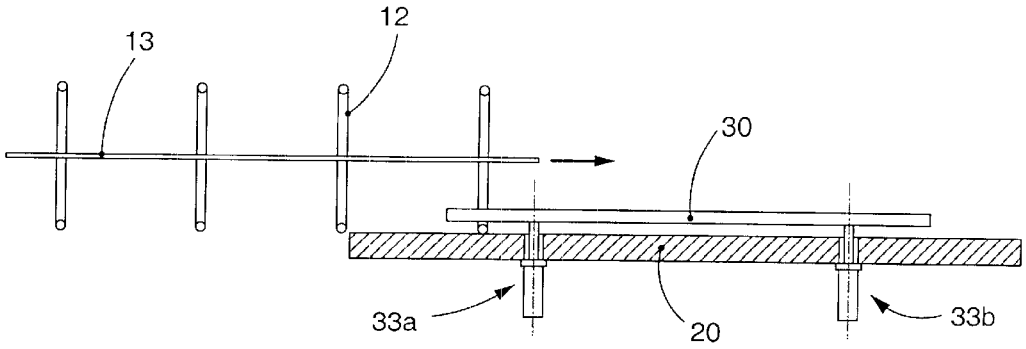
FIGS. 4*a*–4*c* show a variant of FIGS. 3*a*–3*c;*
Figure 4B:
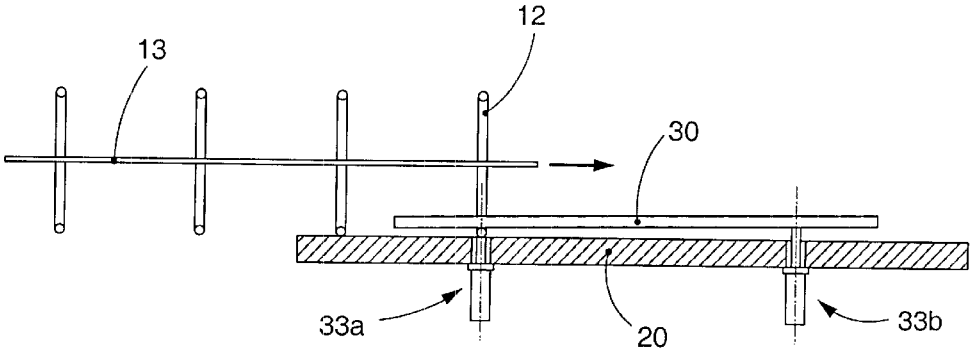
Figure 4C:
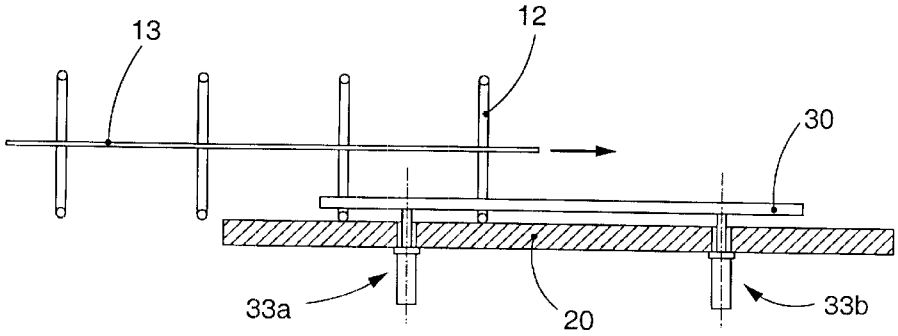

According to a variant shown in FIGS. 4*a*–4*c*, the means to keep the rods 30 raised with respect to the supporting plane 20 comprise two or more movable blades, respectively front 33*a* and rear 33*b*, able to assume alternately a lowered position and a raised position according to the passage of the stirrup 12.

In practice, when the stirrup 12 advancing on the supporting plane 20 approaches the front blade 33*a*, the latter is lowered to the level of or below the plane 20, allowing the lower side of the stirrup 12 to pass because the rods 30 are kept raised by the rear blade 33*b* and by possible other blades located along the plane 20.

As it advances, the stirrup 12 then meets the rear blade 33*b*, which is lowered as the front blade 33*a* is lifted, and so on.

In a position cooperating with the work assemblies 14 and with the supporting plane 20 there is, in this case, an assembly 25 able to make stirrups 12, starting from metal bar or wire, according to a cycle correlated to the cycle to form the pre-cage 11.

The assembly 25 comprises bending means 26, means 27 to feed the bar, shearing means 28 and means 29, in this case of the gripper type, able to pick up each individual formed stirrup 12 on each occasion and to transfer it automatically to the position where it is attached to the round pieces 13.

Figure 5A:
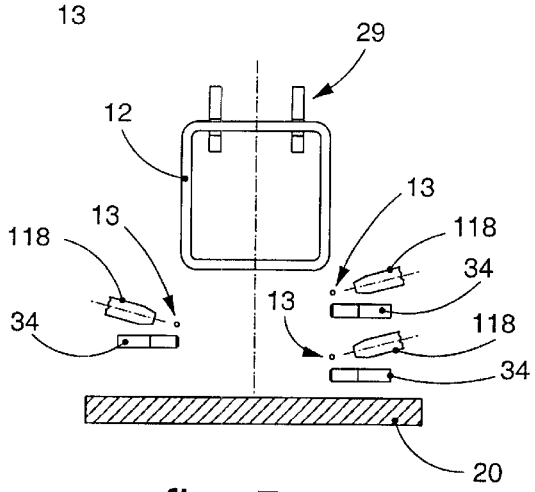
FIGS. 5*a*–5*c* show a front view of a detail of the device shown in FIG. 1, in three steps of the cycle.
Figure 5B:
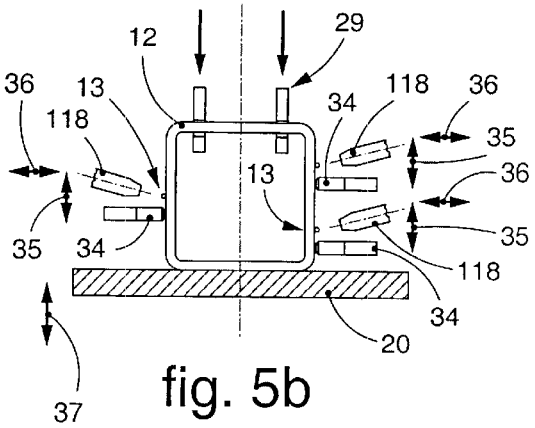
Figure 5C:
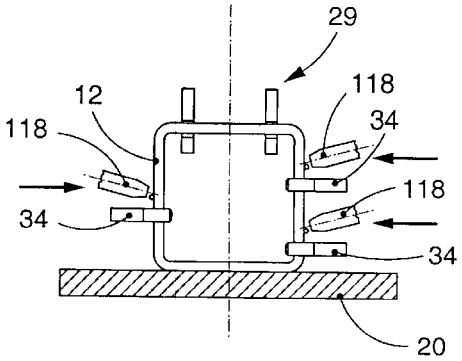

The means 29, in this case, are able to insert and release the stirrup 12 from above in correspondence with the position where it is attached to the round pieces 13 (FIGS. 5*a*–5*c*).

Instead of the gripper-type means 29, the assembly 25 may provide automatic arms, movable planes, translators or other means suitable for the purpose.

The assembly 25 which forms the stirrups 12 is preferentially managed by the same control system which manages the working of the device 10, thus allowing to optimize the cycle and to share resources, which leads to significant savings, with the same level of productivity, in the power used and in the means employed.

In the event that the assembly 25 comprises only means to make the stirrups 12, the action of the means 29 may be carried out by an operator who inserts one stirrup at a time from above between the loops made in the round pieces 13 and rests the stirrup on the plane 20. In this operation guide and centering means 34, associated with a relative welding element 118, may be useful.

The cycle to form the cage 11 provides that the round pieces 13 are made to advance, by means of the relative means 16, until they are in correspondence with the attachment position and, at the same time, the assembly 25 forms a stirrup 12 which is picked up by the means 29 (FIG. 1*a*).

Figure 1B:
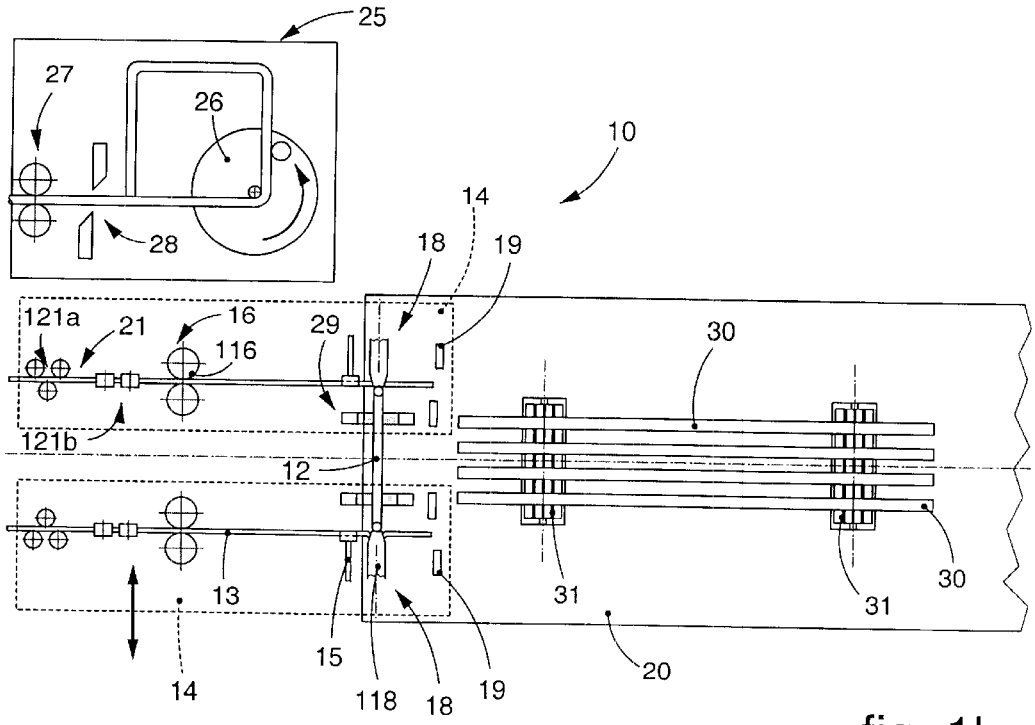

In this position at least one stirrup 12 prepared by the assembly 25 is picked up and located by the means 29 between the round pieces 13 and attached there, for example by welding (FIG. 1*b*).

The lower part of the stirrup 12 rests on the plane 20 and at the sides is kept in an erect position by the elements 34.

The stirrup 12, welded to the round pieces 13, is made to advance on the supporting plane 20 by a step mating with the interaxis according to the design specifications, and a new stirrup 12 is inserted between the round pieces 13.

Figure 1C:
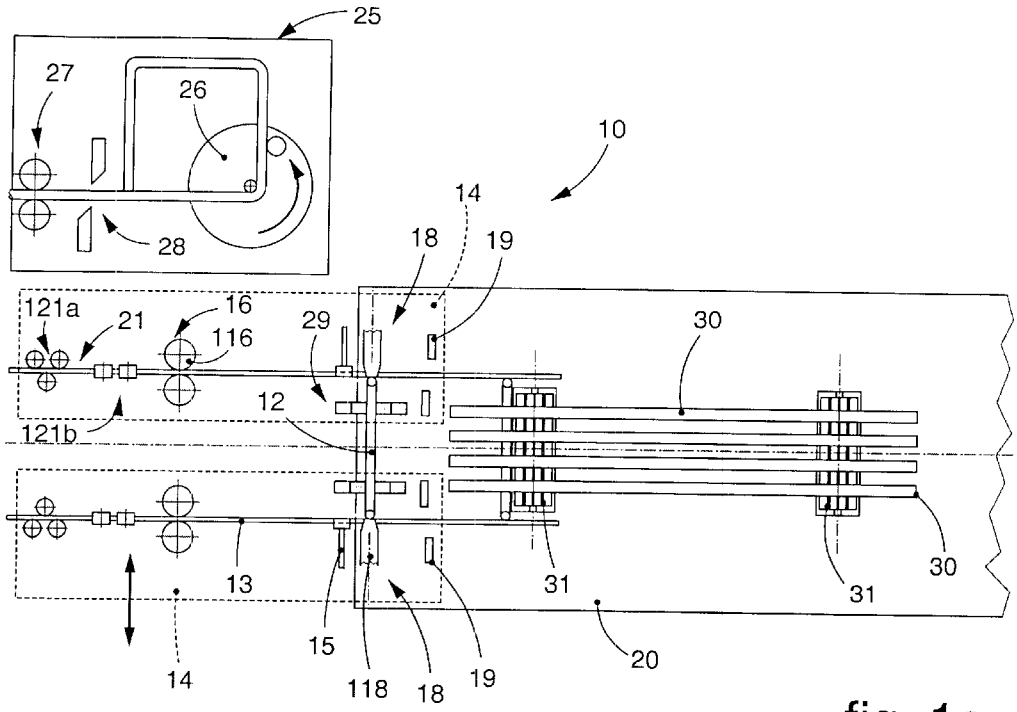
Figure 1D:
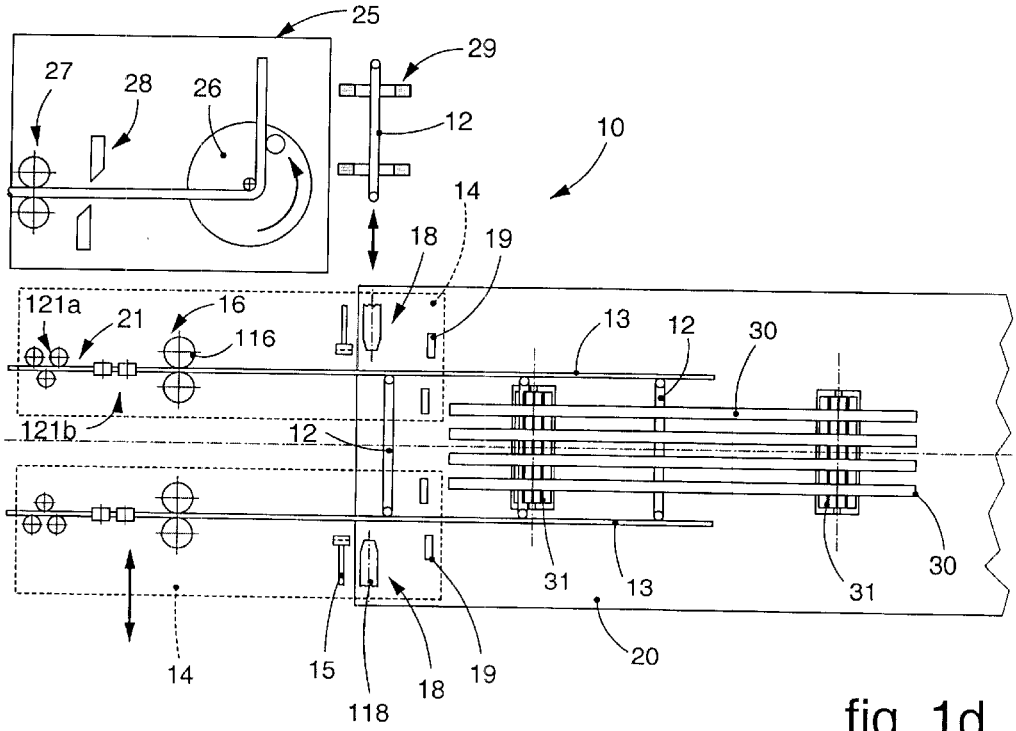
Figure 2:
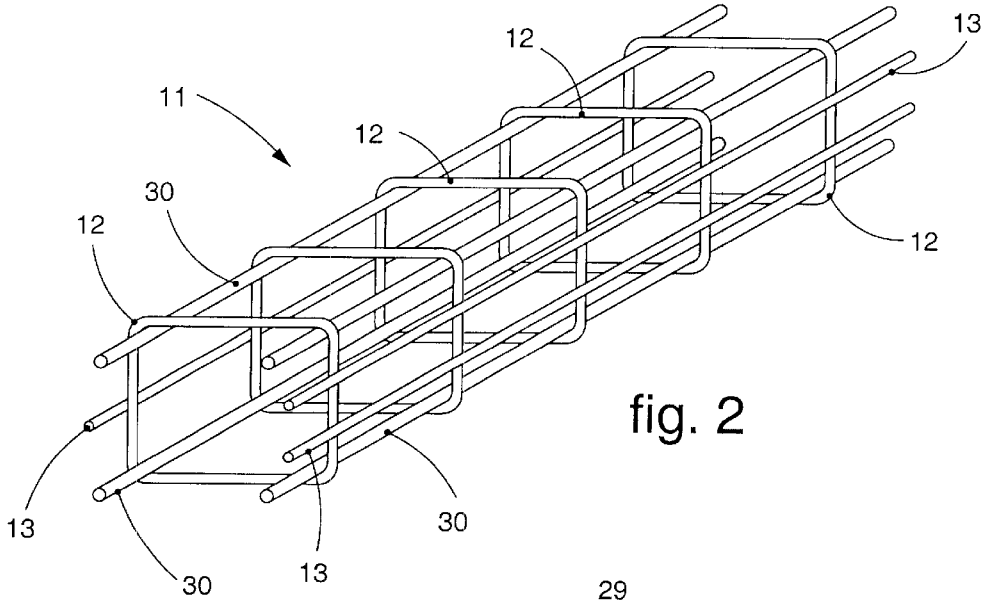
FIG. 2 is a prospective view of a cage made with the device shown in FIG. 1.

Then, the cycle of feeding, positioning and attaching the stirrup 12 is repeated for the following stirrups 12 and the cage 11 which is forming advances on the supporting plane 20 due to the thrust action of the drawing assembly 116, progressively inserting the rods 30 inside the stirrups 12, as seen above (FIG. 1*c*).

In order to locate the round pieces 13 at the desired heights of attachment with respect to the stirrups 12, in a preferential embodiment, the supporting plane 20 is vertically movable in a direction 37 (FIG. 5*b*) with respect to the work assemblies 14, so that, when the stirrup 12 is being positioned between the round pieces 13, it is already in the correct vertical attachment position.

The vertical mobility of the supporting plane 20 may also favor the handling and removal of the completed cage/pre-cage 11.

According to a variant, the supporting plane 20 is stationary, while the work assemblies 14, all together, individually or in groups, are vertically movable in respective directions 35 (FIG. 5*b*) in order to position the round pieces 13 at the heights established by the specifications with respect to the stirrups 12.

In a preferential embodiment, at least the work assemblies 14 located on one side of the machine 10 can be displaced transversely in the direction 36, or also transversely, to adapt to the width of the stirrups 12, so as to be able to work stirrups 12 of very different shape and size.

The attachment means 18 for each round piece 13 comprise at least a welding element 118 able to move from an inactive position (FIG. 5*b*), wherein it is distant from the relative round piece 13, to an active position (FIG. 5*c*) wherein it approaches the round piece 13 to attach it to the stirrup 12.

In this case, each welding element 118 cooperates with a pressure element 15 which intervenes in the welding step, holding the stirrup in a very close position to the relative round piece 13 and facilitating an efficient and long-lasting weld.

Every work assembly 14 may comprise, according to a variant, punching means able to achieve on the round pieces 13 a plurality of loops which define the positioning and attachment seatings of the stirrups 12.

Every work assembly 14 also comprises shears means 19, which in this case are arranged downstream of the relative welding element 118. Said shears means 19, according to a variant, are located upstream of the relative welding element 118.

The shears means 19 are able to shear the relative round pieces 13 when the cage or pre-cage 11 is completed, or when there are blockages or other problems which require the work cycle to be interrupted.

Modifications and variants may be made to the invention, but these shall remain within the field and scope thereof.

For example, supplementary means may be provided able to support the stirrups 12 during the operation to attach them to the longitudinal round pieces 13.

In the event that longitudinal round pieces 13 are used in the form of bars sheared to size, the shears 19 may be omitted. A further variant may provide that the optional punching means and the attachment means 18 can operate on the same vertical plane, so that the shaping and attachment of the round pieces 13 occur substantially in the same position.

What is claimed is:

1. An apparatus for producing reinforcement metal cages comprising a plurality of longitudinal round pieces associated with a plurality of stirrups arranged at intervals along the longitudinal round pieces, the apparatus comprising a supporting plane on which a reinforcement metal cage can be progressively formed, said supporting plane being able to support rods which are to be inserted into a cage being formed to complete the cage, and wherein a plurality of lifting means are distributed along said supporting plane to keep said rods raised with respect to the supporting plane at least during an advance of the cage which is progressively formed, and said lifting means being movable to permit said stirrups to pass between said rods and said support plane when advanced past said lifting means for inserting said rods inside a perimeter of the stirrups.

2. An apparatus as in claim 1, wherein said lifting means comprise at least a roller arranged with its axis substantially orthogonal to an axis of advance of the cage and including a plurality of paddles protruding at least partly above said supporting plane.

3. An apparatus as in claim 2, wherein said paddles are present in such a number that they are always operative on said rods.

4. An apparatus as in claim 3, wherein there are at least six of said paddles.

5. An apparatus as in claim 2, wherein said paddles are able to hold the rods raised for a value at least such as to allow a passage of a lower part of the stirrups below the rods, and are able to be made to rotate together with an associated roller at a moment said stirrups come into contact with and thrust upon said paddles.

6. An apparatus as in claim 1, wherein said plurality of lifting means comprise respective blades having alternately a lowered position below said supporting plane and a raised position above said supporting plane; wherein when a first blade is in the lowered position to allow a relative stirrup to pass, a second blade is in the raised position to lift the rods and vice versa.

7. An apparatus as in claim 1, further comprising stepwise feed means for feeding said longitudinal round pieces, stirrup positioning means for positioning stirrups and at least a work assembly for at least each of said round pieces.

8. An apparatus as in claim 7, wherein said work assembly comprises at least reciprocal attachment means for attaching a stirrup and a round piece to one another.

9. An apparatus as in claim 8, wherein said attachment means includes at least a welding element.

10. An apparatus as in claim 9, wherein said welding element is associated with at least a relative pressure element to assisting in welding.

11. An apparatus as in claim 7, wherein said means to position the stirrups includes positioning and centering elements laterally of the stirrups and said supporting plane below.

12. An apparatus as in claim 1, further comprising means for vertically adjusting a position of said supporting plane.

13. An apparatus as claim 7, further comprising means for vertically adjusting a position of at least one of said work assemblies.

14. An apparatus as in claim 7, further comprising means for adjusting a position at least one of said work assemblies laterally.

15. An apparatus as in claim 1, further comprising at least an assembly for making the stirrups in a manner functionally correlated to one advance of said round pieces into an attachment position where said round pieces are attached to said stirrups.

16. An apparatus in claim 15, wherein said assembly comprises at least bending means for bending a bar to make a stirrup, bar feed means for feeding a bar to make a stirrup, and shearing means for shearing a bar to make a stirrup.

17. An apparatus as in claim 15, wherein said assembly comprises means for picking up a stirrup formed and placing it in correspondence with said attachment position.

* * * * *